US006079191A

United States Patent [19]

Borkiewicz et al.

[11] Patent Number: 6,079,191

[45] Date of Patent: Jun. 27, 2000

[54] AUTOMATED LOADING OF PICKLES INTO JARS

[75] Inventors: Zbigniew S. Borkiewicz, Sun Prairie; Tod W. Heleniak, Green Bay; Larry E. Daane, Horicon, all of Wis.

[73] Assignee: Kraft Foods, Inc., Northfield, Ill.

[21] Appl. No.: 09/208,723

[22] Filed: Dec. 9, 1998

[51] Int. Cl.[7] ..... B65B 63/00

[52] U.S. Cl. ..... 53/515; 53/435; 53/236; 53/247; 53/252

[58] Field of Search ..... 53/515, 435, 236, 53/247, 252; 83/932, 425.2, 858

[56] References Cited

U.S. PATENT DOCUMENTS

| | | | |
|---|---|---|---|
| Re. 27,852 | 12/1973 | Eisenberg | 53/515 |
| 3,468,098 | 9/1969 | Eisenberg | 53/515 |
| 3,662,518 | 5/1972 | Eisenberg | 53/515 |
| 4,453,368 | 6/1984 | Egee | 53/515 |
| 4,539,879 | 9/1985 | Egee | 53/515 |
| 4,646,509 | 3/1987 | Tribert | 53/515 |

*Primary Examiner*—Brian L. Johnson
*Assistant Examiner*—Matthew Luby
*Attorney, Agent, or Firm*—Cook, Alex, McFarron, Manzo, Cummings & Mehler, Ltd.

[57] ABSTRACT

The assembly and method are disclosed for the mechanical automated loading of cut cucumbers into jars. The cucumbers are sized in length and delivered to one or more cutter and loader stations where they are cut into slices or the like, and the slices are divided between a pair of pivot chutes. The pivot chutes are pivoted away from each other and into alignment respectively with a pair of jar chutes, the latter of which extend into the openings of the jars to be loaded. The cut cucumbers are delivered through the jar chutes at a substantial angle to both the plane of the opening of the jar and the axis of the jar, and toward the outer wall of the jars against which they are deposited. As each load is deposited into a jar, the jar is rotationally indexed in readiness for the next load, and the previously deposited loads are held against the outer wall of the jar by a mandrel which extends into the jar during the loading operation.

54 Claims, 10 Drawing Sheets

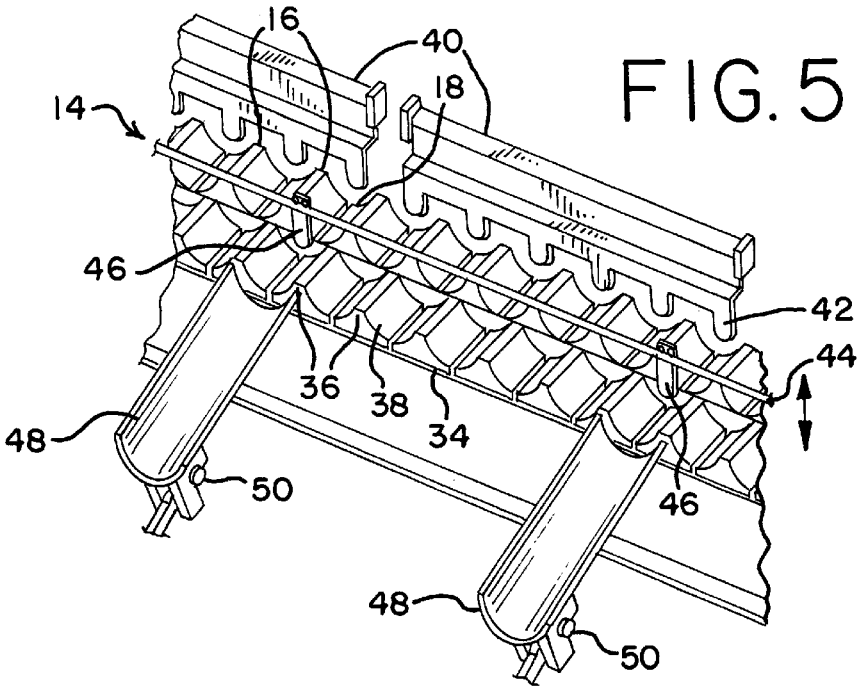
FIG. 5
FIG. 6A
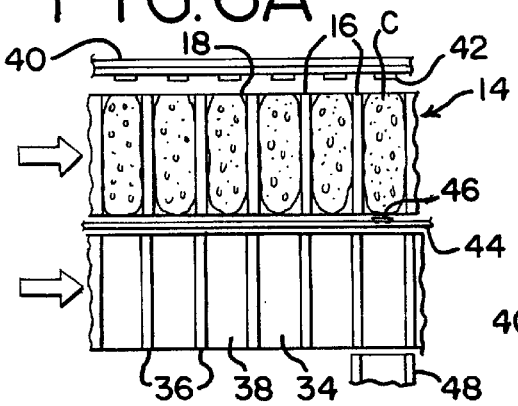
FIG. 6C
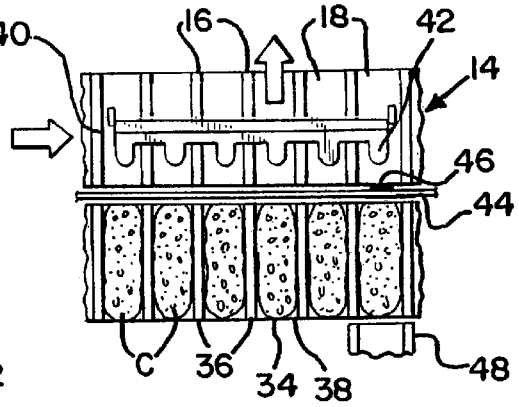
FIG. 6B
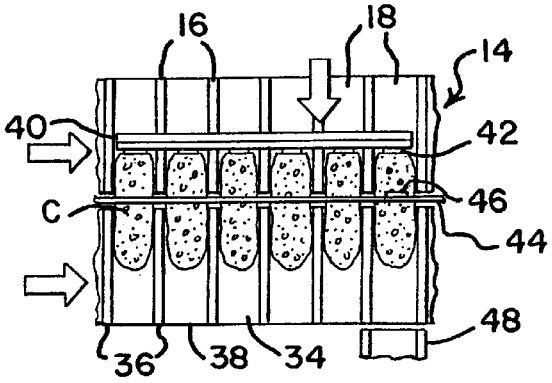

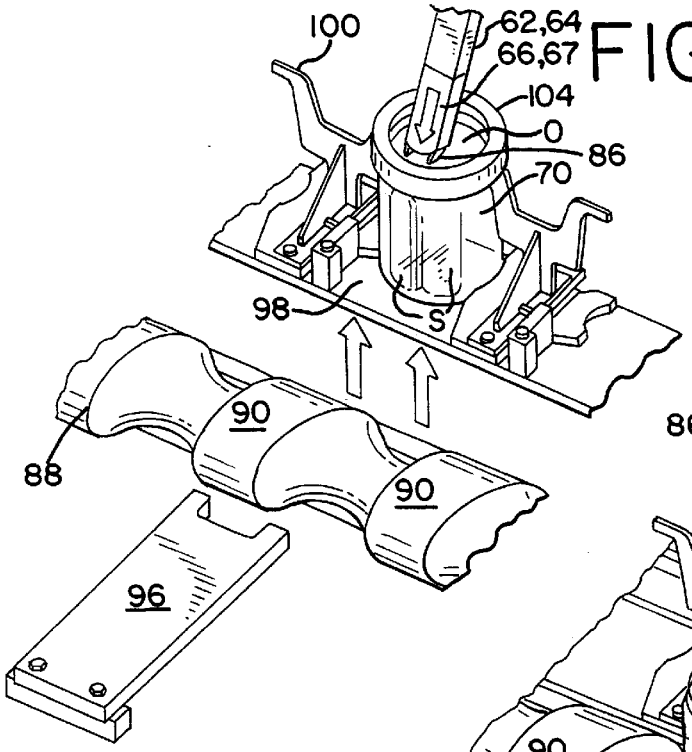
FIG. 26D
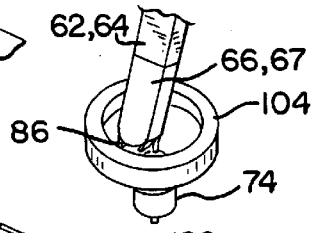
FIG. 26E
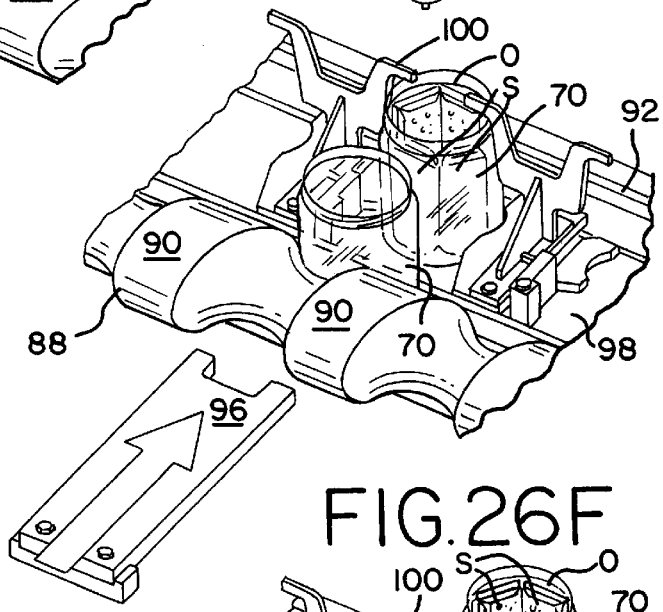
FIG. 26F
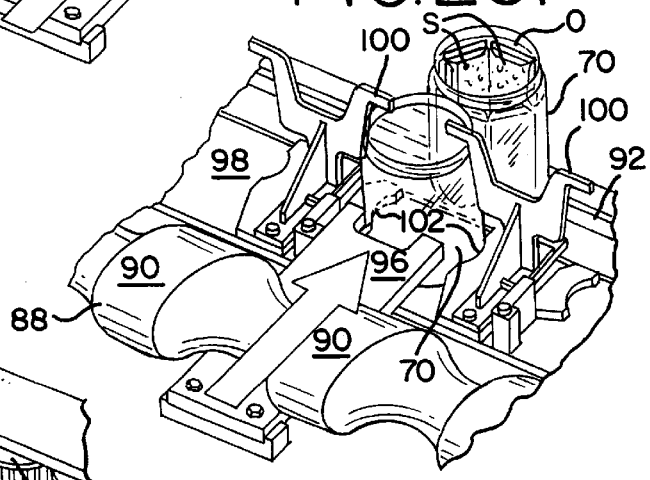
FIG. 27
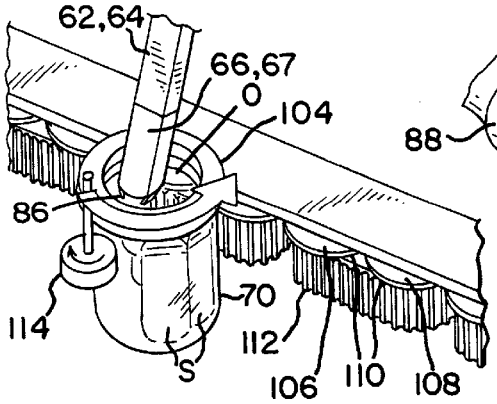

AUTOMATED LOADING OF PICKLES INTO JARS

BACKGROUND AND SUMMARY OF THE INVENTION

The present invention is directed to the loading of cut cucumbers into containers or jars and, more specifically, to a method and assembly for the loading of cut cucumbers into containers or jars for curing into pickles and the marketing of the loaded pickles.

The proper curing of cucumbers to produce pickles is essential to obtaining high quality taste, consistency and crispness of the pickles. In order to accomplish this proper cure, the ratio between cucumber mass and the brine must be carefully controlled. Where curing is to be accomplished in the jar or container in which the pickles are to be ultimately marketed, tight packing of cucumber halves, slices or other cut forms is needed to obtain the appropriate ratio between cucumber mass and brine. Tight packing is also important to the appearance of the pickles in the jar at the point of marketing. This requisite tight packing and ratio of cucumbers to brine is not always capable of being accomplished by manual loading of the cut cucumbers into the jars, and mechanized assemblies and methods for automated loading heretofore were also unavailable which would consistently function to load the cucumbers into the jar without unacceptable damage to the cut cucumbers or consistently ensure the correct cucumber to brine ratio.

It has been discovered in the present invention that both appearance and desired tightness of pack may be accomplished by mechanical automated loading of cut cucumber parts into a jar. In the assembly and method of the present invention this mechanical automated loading is capable of higher loading speeds than prior hand packing procedures, and the inconsistencies and labor costs which attended the manual loading procedures are avoided. Moreover, damage and breaking of the cut cucumber pieces during loading is minimized.

In the assembly and method of the present invention, the cut cucumbers are divided between a pair of receptacles, one for each of two containers or jars. The cut cucumber pieces are then inserted into the containers or jars on an angle across the neck or opening of the respective containers or jars, with a cut face of the cucumber which is being inserted into the jar facing upward. Once the cucumber pieces have entered the jar opening, the pieces are directed toward the outer wall of the jar. These procedures minimize detrimental bending of the cucumber which might otherwise result in damage to the cucumber, and yet a tight pack of the cucumber pieces can be accomplished mechanically and in an automated fashion. The present invention also permits tight loading of the cucumbers around the outer wall of the jar or container in a manner which leaves the center empty for the subsequent loading of additional cut cucumber pieces in order to obtain the required cucumber to brine ratio.

In one principal aspect of the present invention, a method of loading elongated articles of food into a container comprises positioning an elongated article of the food in a first receptacle and longitudinally moving the article from the first receptacle into and past at least one knife to slice the article over its length into at least two pieces and to urge the sliced pieces beyond the knife and into a pair of second elongate tubular receptacles such that the sliced pieces are divided between the second receptacles. The second receptacles are axially aligned with the first elongate receptacle during slicing of the article of food. The pair of second receptacles with the sliced pieces therein are moved apart from each other and to a position in which each of the respective pair of second receptacles with the sliced pieces therein is aligned with an opening in one of a pair of the containers which are to be loaded. The sliced pieces are longitudinally moved from their respective second receptacles into each of the respective containers to deposit the sliced pieces from one of the second receptacles into one of the containers and the sliced pieces from the other of the second receptacles into the other of the containers.

In another principal aspect of the present invention, a method of loading elongated articles of food into a container comprises slicing the article over its length into at least two pieces with a knife, and separating the sliced pieces and the knife from each other. At least one of the sliced pieces is moved across the opening of one of the containers which is to be loaded and at a substantial angle both to the axis of the container and to the opening of the container, and in a direction toward the outer wall of the container to deposit the sliced pieces into the container.

In still another principal aspect of the present invention, the foregoing methods include exerting a force on the end of the article of food opposite the end that is moved into the knife to move the article into and beyond the knife.

In still another principal aspect of the present invention, in the foregoing methods the article of food is moved past a plurality of knives to form a plurality of slices, and half of the slices are urged into one of the second elongate receptacles, and the remaining half of the slices are urged into the other of the second elongate receptacles.

In still another principal aspect of the present invention, the foregoing methods include slicing a portion of the outer surface of the article of food from the food and discarding it prior to urging the slices into their respective containers.

In still another principal aspect of the present invention, in the foregoing methods when the sliced pieces are urged into the pair of second receptacles, the receptacles are positioned adjacent each other and when the receptacles are moved apart, they are pivoted about 90° from each other.

In still another principal aspect of the present invention, when each of the sliced pieces is moved from its respective second receptacles into each of its respective containers, it is moved at a substantial angle both to the axis of the container and to the opening of the container and toward the outer wall of the container, and preferably the angle relative to the opening of the container is about 60–75°.

In still another principal aspect of the present invention, in the foregoing methods each of the sliced pieces has at least one open face thereon which is formed by the slicing, and that open face of the sliced pieces is positioned to face substantially away from the opening of the container as the sliced pieces are moving at a substantial angle to the opening of the container to permit the sliced pieces to bend as they are entering the opening, and the open face faces the wall of the container after the sliced pieces have been deposited in the container.

In still another principal aspect of the present invention, in the foregoing methods a deposit chute is located between each of the second receptacles and its respective container, and at least one of the respective deposit chutes of each of the second receptacles and the containers are moved relative to each other so that each of the respective deposit chutes is positioned into its respective container, and is retracted from in the last mentioned position following deposit of the sliced pieces in the respective container.

In still another principal aspect of the present invention, in the foregoing methods each of the containers is rotationally indexed about their respective axes following the deposit of the sliced pieces into the respective containers, and the previously performed steps are sequentially repeated to deposit additional sliced pieces into each of the containers and next to the previously deposited sliced pieces.

In still another principal aspect of the present invention, the foregoing methods include holding the sliced pieces which have been deposited in each of the containers against the outer wall of the containers while the containers are being rotationally indexed.

In still another principal aspect of the present invention, the foregoing methods include laterally moving next adjacent previously deposited sliced pieces so as to make room for subsequently deposited sliced pieces simultaneously with the deposit of the next subsequently deposited sliced pieces.

In still another principal aspect of the present invention, an assembly for loading elongated articles of food into a container comprises a first elongate receptacle for receiving one of the elongated articles of food, at least one knife associated with the first receptacle, and a pusher for pushing the article of food in the first receptacle past the knife to slice the article of food over its length into a least two pieces. A pair of second movable elongate receptacles are provided which are movable between a first position in which they are positioned adjacent each other and to receive each of the respective sliced pieces as they move past the knife, and a second position in which the pair of second movable elongate receptacles are spaced apart from each other. A container positioning means is provided for positioning at least two containers with openings such that the openings of the respective containers are aligned with each of the respective second movable elongate receptacles when those receptacles are in their spaced apart second position, and a pusher pushes each of the two respective sliced pieces from their respective second movable elongate receptacles into each of the respective containers to deposit the respective sliced pieces into the respective containers.

In still another principal aspect of the present invention, the foregoing assembly the knife is positioned adjacent a discharge end of the first elongate receptacle, and the pusher for pushing the article of food past the knife is constructed and arranged to push the end of the article opposite the knife toward the knife.

In still another principal aspect of the present invention, in the foregoing assemblies a plurality of knives form a plurality of sliced pieces, and when the article of food is being sliced, the pair of second movable elongate receptacles are positioned so that one of the second movable elongate receptacles receives some of the sliced pieces and the other of the movable elongate receptacles receives the remainder of the sliced pieces.

In still another principal of the present invention, the foregoing assemblies include a knife for slicing a portion of the outer surface of the article of food from the food, and means is provided for diverting the sliced portion of the outer surface from the second movable elongate receptacles.

In still another principal aspect of the present invention, in the foregoing assemblies the second movable elongate receptacles are pivoted about 90° from each other when they are moved between the first and second positions.

In still another principal aspect of the present invention, the foregoing assemblies include a deposit chute between each of the second movable elongate receptacles and its respective container when the second receptacles are in the second position, and means is provided for moving the chute and/or its container relative to each other so that the chute extends into the opening of its container for the deposit of the sliced pieces into the container, and the chute is removed from the container opening following the deposit of the sliced pieces.

In still another principal aspect of the present invention, in the foregoing assemblies the deposit chutes extend at a substantial angle both to the axis of the container and to the opening of the container and toward the outer wall of the container which has been positioned for deposit of the food and when the second movable elongate receptacles have been positioned in the second position, and preferably the angle relative to the opening of the container is about 60–75°.

In still another principal aspect of the present invention, the foregoing assemblies include indexing means for rotationally indexing the containers about their respective axes following the deposit of the sliced pieces into the respective containers to permit the subsequent deposit of additional sliced pieces into each of the containers.

In still another principal aspect of the present invention, the foregoing assemblies include resilient fingers for laterally spacing previously deposited sliced pieces from sliced pieces which are subsequently being deposited next adjacent to the previously deposited sliced pieces.

In still another principal aspect of the present invention, the foregoing assemblies include a mandrel which extends into each container during the deposit of sliced pieces into the container, and which is constructed and arranged to hold the sliced pieces against the outer wall of the container as the container is being indexed.

In still another principal aspect of the present invention, the elongated articles of food are cucumbers.

These and other objects, features and advantages of the present invention will be more clearly understood through a consideration of the following detailed description.

BRIEF DESCRIPTION OF THE DRAWINGS

In the course of this description reference will frequently be made to the attached drawings in which:

FIGS. 5 and 6A–6G are partially broken, perspective and plan views of another portion of the cucumber delivery section substantially as shown in FIG. 1 and showing the transfer of the cut-to-length cucumbers to the staging shuttles and tip-ups of the cucumber delivery section;

FIGS. 24, 25A–25B and 26A–26F are partially broken, perspective views of a preferred embodiment of jar handling section, as substantially as shown in FIG. 1, for delivering empty jars to be loaded to the assembly, for positioning the jars to be loaded, and for removing the jars which have been loaded with the cut cucumber pieces; and FIG. 27 is a perspective view of a preferred embodiment of mechanism for indexing the jar between loading steps.

DETAILED DESCRIPTION OF THE PREFERRED EMBODIMENTS

Figure 1:
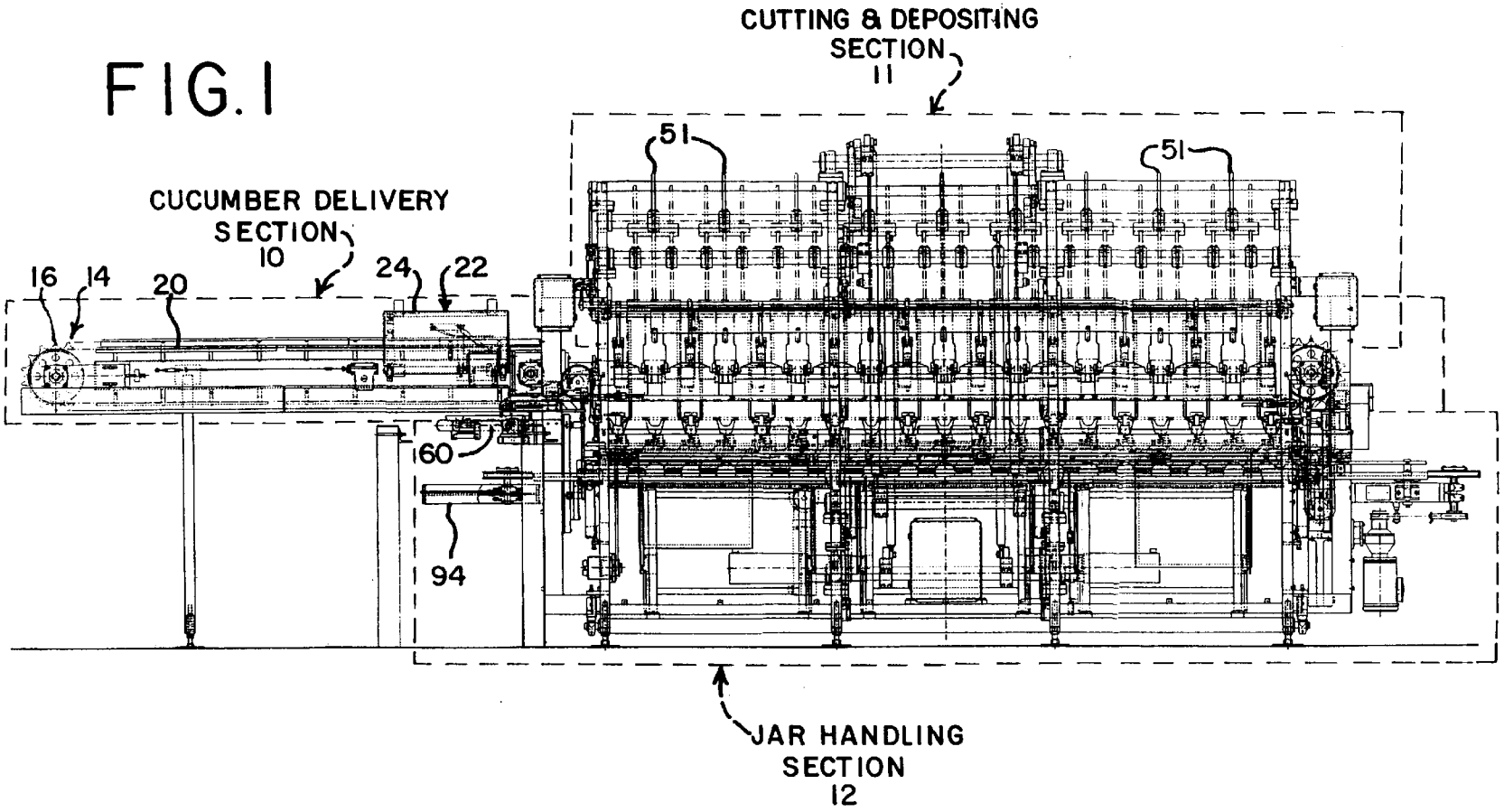
FIG. 1 is an overall side elevation view of an assembly constructed in accordance with the principles of the present invention for the mechanical automated handling and loading of cucumbers into jars and for practicing the method of the invention.

As shown generally in FIG. 1, a preferred assembly in accordance with the present invention and for practicing the method of the invention preferably comprises three principal sections: a cucumber delivery section 10, a cutting and depositing section 11 and a jar handling section 12.

The cucumber delivery section 10 receives the cucumbers to be processed and loaded in the present invention, trims them to length to conform to the size of the jars or containers into which they are to be loaded, and stages them for processing in the next section, the cutting and depositing section 11.

In the cutting and depositing section 11, the cucumbers are cut lengthwise to the cut form in which they are to be loaded into the jars. This slicing may take any one of several different forms which may include halves or plural slices as are described hereafter.

The jar handling section 12 delivers the empty jars to be loaded to the assembly shown in FIG. 1, positions the jars for loading with the cut cucumbers, and removes the loaded jars from the assembly after loading has been accomplished, while also delivering and positioning a new set of empty jars for loading.

The Cucumber Delivery Section

Figure 2:
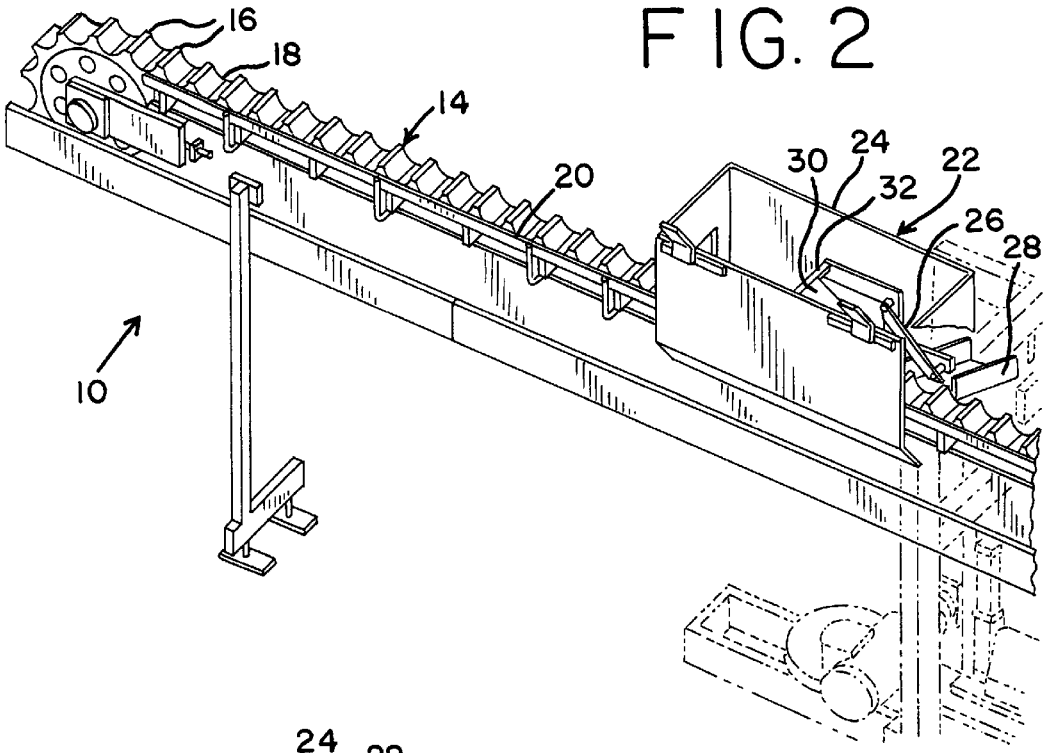
FIGS. 2–4 are partially broken, perspective and plan views of a portion of the cucumber delivery section, as substantially shown in FIG. 1, and showing in more detail components of the cucumber delivery section including the cut-to-length slicer.
Figure 3:
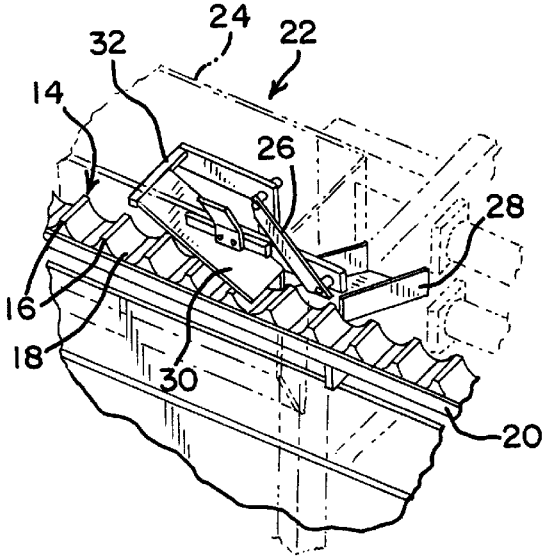
Figure 4:
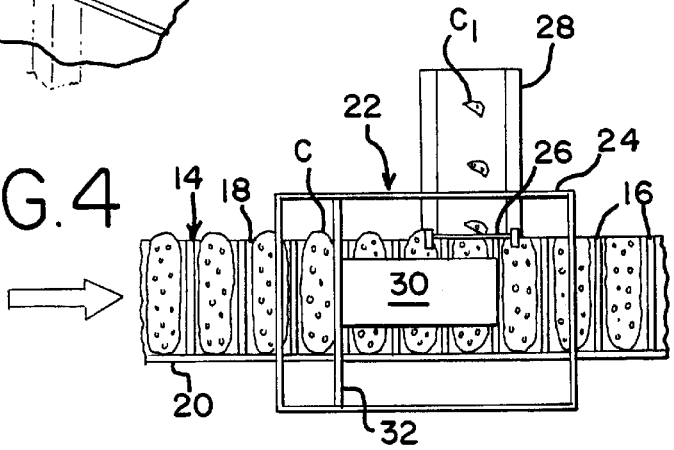

Referring to FIGS. 1–4, the cucumber delivery section 10 comprises a conveyer 14 having a plurality of spaced extended lugs 16 which define pockets 18 between them, as best seen in FIG. 4, in which the cucumbers C to be processed are positioned. The cucumbers C may be manually positioned in the pockets 18 by either a separate machine (not shown) or by one or more operating personnel. When the cucumbers C are positioned in the pockets 18, one end of each of the cucumbers is brought to bear against a guide rail 20 which extends longitudinally of the conveyer and along one of its sides, as best seen in FIGS. 2–4. The guide rail 20 provides a reference for sizing the length of the cucumbers C as will next be described.

As the conveyer 14 is moved to the right, as viewed in FIGS. 1–4, it will carry the cucumbers C which have been loaded into the pockets 18 to a cut-to-length slicer 22. The slicer 22 includes a safety enclosure 24 which surrounds a stationary knife 26. The knife 26 is attached at each of its ends preferably to the structure of the enclosure 24 at the side of the conveyor 14 opposite the guide rail 20 and at an angle to the path of movement of the cucumbers C. As the cucumbers C pass and move beneath the angled knife 26, any cucumbers which may be of excessive length have their ends cut off by the knife, as best seen in FIG. 4, and the scrap ends C, are discarded from the slicer 22 by a scrap chute 28.

A flexible hold down rail 30 is also mounted at its upper end by a rod 32 or other suitable rigid support structure in the safety enclosure 24, as best seen in FIGS. 2–4. The flexible hold down rail 30 extends downwardly at an angle as seen in the drawings so that its bottom end bears against the cucumbers C as they pass beneath the hold down rail 30 during the cut-to-length slicing operation.

The cut-to-length slicer 22 assures that each of the cucumbers C will be of a generally uniform length which will not exceed such length as might impair the proper loading of the cucumbers into the containers or jars. Although this length may vary depending upon the dimensions of the container or jar, a cucumber length of 4–4⅝ inches is typically preferred. Obviously any cucumbers which are already of this size or shorter, will pass the cut-to-length slices 22 without contacting the knife 26.

Figure 6E:
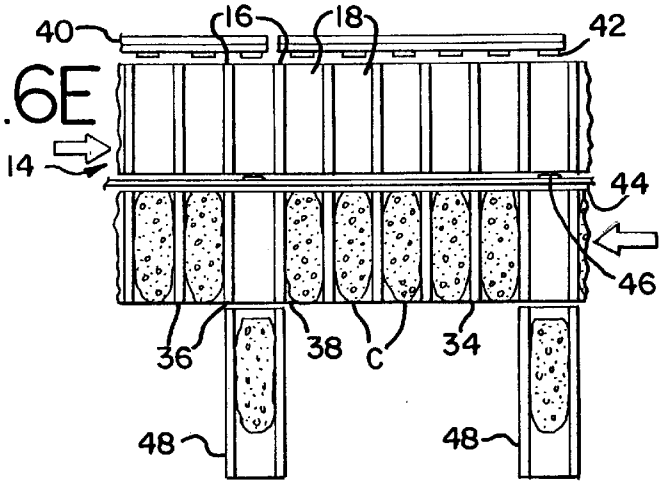

Following the trimming of the cucumbers C to their proper length, the conveyor 14 continues to convey the cucumbers C at a constant speed to a transfer area of the cucumber delivery section 10. This transfer area and its operation is best viewed in FIGS. 5 and 6A–G. As best seen in FIGS. 5 and 6A, the conveyor 14 continuously conveys the trimmed cucumbers C to a position in which they are in alignment with a staging shuttle 34. Like the conveyor 14, the shuttle also includes a plurality of spaced lugs 36 which also define pockets 38 which are aligned with the pockets 18 on the conveyor 14 for the receipt of cucumbers C from the conveyor.

One or more transfer pushers 40 are also positioned to cooperate with the staging shuttle 34 and conveyor 14. The transfer pushers 40 are normally positioned at the side of the conveyor 14 opposite the staging shuttle 34, as best seen in FIGS. 5 and 6A. When the moving staging shuttle 34 matches the speed of the conveyor 14 which is fully loaded with cucumbers so that it has been positioned in alignment with the conveyor 14, as shown in FIG. 6A, the transfer pusher 40 which also moves longitudinally with the continuously moving conveyor is rotated downward, preferably pneumatically, and actuated transversely, preferably mechanically, so that downwardly extending fingers 42 on the transfer pusher will engage the cut ends of the cucumbers C and push the cucumbers from their pockets 18 on the conveyor 14 into the aligned pockets 38 on the staging shuttle, as best seen in FIG. 6B.

Once the cucumbers C have been positioned in the respective pockets 38 of the staging shuttle 34, as seen in FIG. 6C, the transfer pusher 40 is again rotated upwardly and out of the way of oncoming cucumbers on conveyor 14 and retracted to its initial position outside of the conveyor 14 in readiness for another load of cucumbers to be positioned for transfer by the conveyor.

A kicker transfer 44 extends along the length of the staging shuttle 34 and has fingers 46 spaced along its length at intervals. The intervals between the fingers 46 preferably are equal to the number of pockets 38 in the staging shuttle 34 which need be filled by cucumbers in order to complete the loading of one container or jar. For example, if six cucumbers are needed to fully load the outer wall of the jar, a finger 46 will be positioned every sixth pocket 38 along the staging shuttle 34.

Figure 6D:
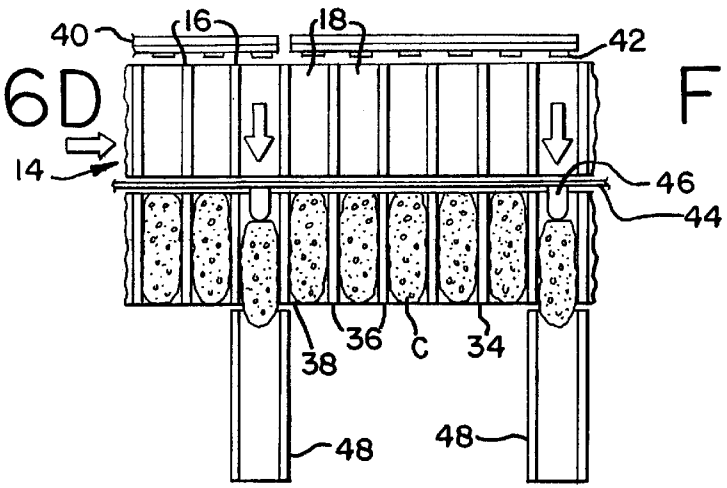
Figure 7:
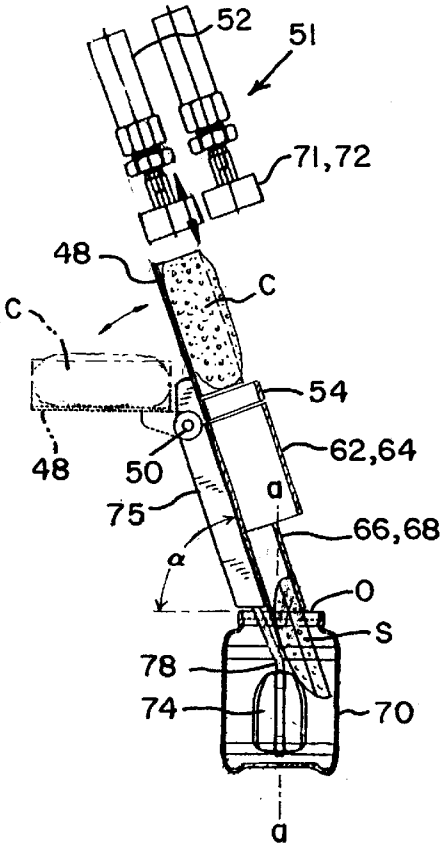

When the cucumbers C are being pushed by the transfer pusher 40 from the pockets 18 of the conveyor 14 to the pockets 38 of the staging shuttle 34, the kicker transfer 44 and its fingers 46 are raised upwardly as shown by the double arrow in FIG. 5 and out of the way of the cucumbers which are being transferred to permit completion of the transfer to the staging shuttle 34, as shown in FIGS. 6B and 6C. Once the transfer of the cucumbers C to the pockets 38 of the staging shuttle 34 is complete and the transfer pusher 40 has been retracted as seen in FIG. 6D, the kicker transfer 44 and its fingers 46 are lowered, preferably pneumatically, so that the fingers extend in a vertical fashion just behind the cut-to-length end of a cucumber which is directly in the path of each of the fingers 46 and then the fingers are abruptly rotated about 30° from the vertical, as shown in FIG. 6D, to kick the cucumber to a receptacle which in preferred form is a tip-up 48, as shown in FIGS. GD and 6E. As seen in FIGS. 5 and 7, the tip-up 48 is pivotally mounted at 50 so that once the cucumber C has been transferred to the tip-up, the tip-up can be tilted up as seen in FIG. 7, to introduce the cucumber to the cutting and depositing section 11, as will be described to follow. At this time, the kicker transfer fingers 46 are rotated back to their vertical position.

Figure 6G:
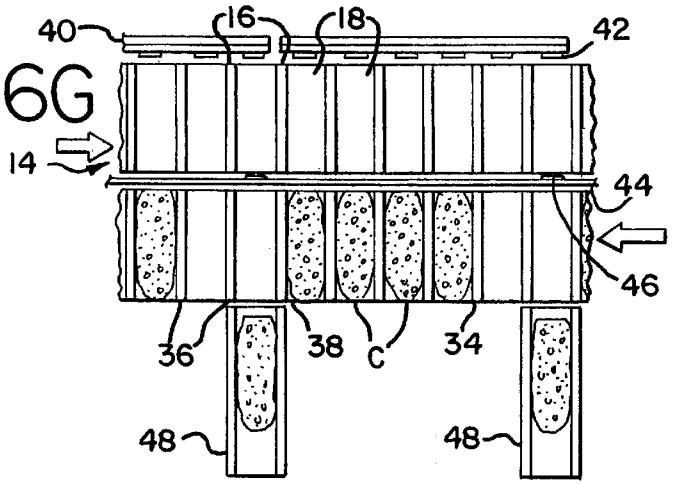
Figure 6F:
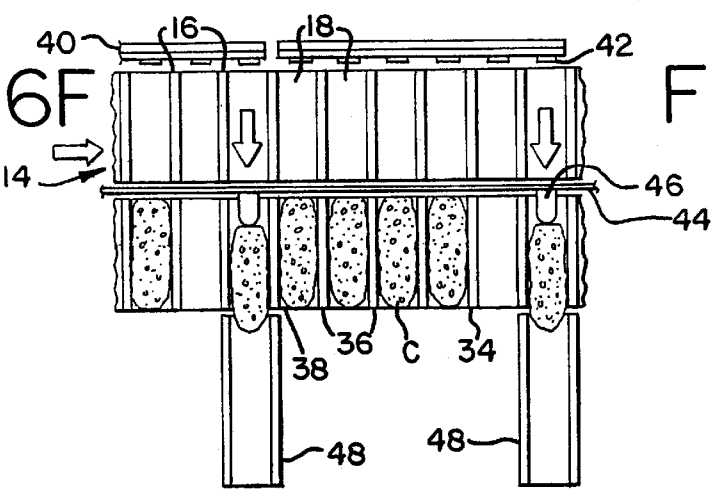

As the cucumber C is processed in the cutting and depositing section and loaded into the jar, the tip-up 48 will be returned empty to the position shown in FIG. 6F in readiness to receive the next cucumber. When the tip-up 48 is ready to receive that next cucumber, the staging shuttle 34 is or will have been indexed to the left one pocket, as shown by the arrow in FIG. 6E, to align the next cucumber with the tip-up 48 which is now ready to receive it. When the next cucumber is ready to be processed in the cutting and depositing section 11, the kicker transfer 44 is again rotatably actuated, and its spaced fingers 46 will kick another cucumber into each of the tip-ups 48, as shown in FIGS. 6F and 6G.

The Cutting and Depositing Section

The components and the operation of the cutting and depositing section are best seen in FIGS. 7–11.

Figure 10:
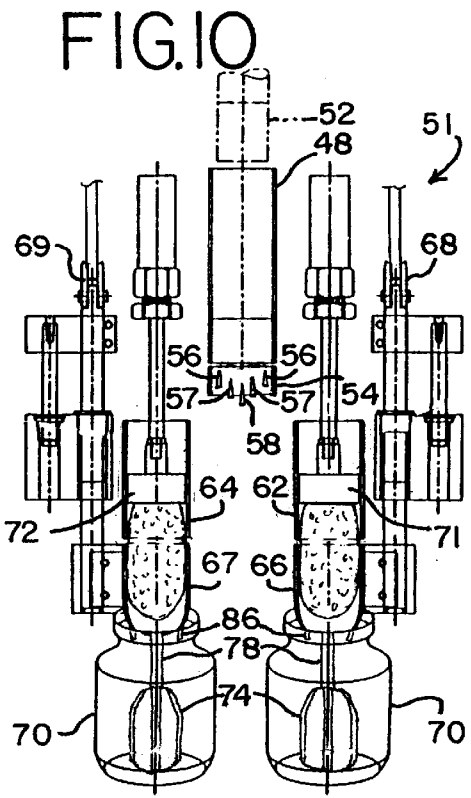
FIGS. 7–11 are partially broken, elevation and plan views showing the components and operation of a preferred embodiment of cutting and depositing section of the assembly, as substantially as shown in FIG. 1.
Figure 8:
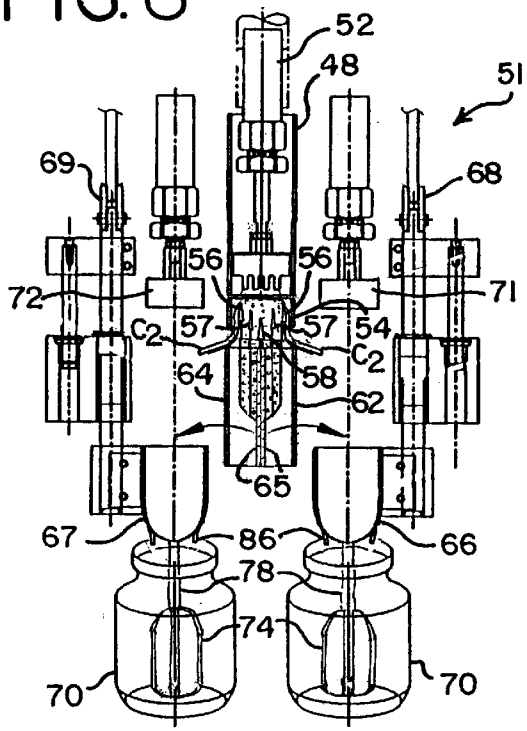

When the cucumber C has been delivered by the spaced fingers 46 of the kicker transfer 44 to the tip-up 48, as viewed in FIG. 6G, the tip-up is tipped up to a more vertical position, as seen in FIG. 7, about the pivot mount 50 and into a cutter and loader station, generally assembly 51. The cutting and depositing section 11 preferably includes a number of cutter and loader stations 51 so that a large number of cucumbers may be simultaneously processed and loaded into jars. When the tip-up 48 is tipped up into its cutter and loader station 51, it and its cucumber C are positioned in longitudinal alignment with a cucumber cut pusher 52, as seen in FIGS. 7, 8 and 10. At this time, the cucumber pusher 52 advances against the cut-to-length end of the cucumber C to push the cucumber down onto one or more knife blades which are positioned in a knife frame 54. A centering device (not shown) provides a guide for the cucumber C which is being pushed by the cucumber pusher 52 against its cut-to-length end to push the cucumber through the knives. The cucumbers are positioned in the center of the knife frame 54 so the two sets of slices are loaded evenly into pivot chutes 62 and 64 as will be described below.

Figure 24:
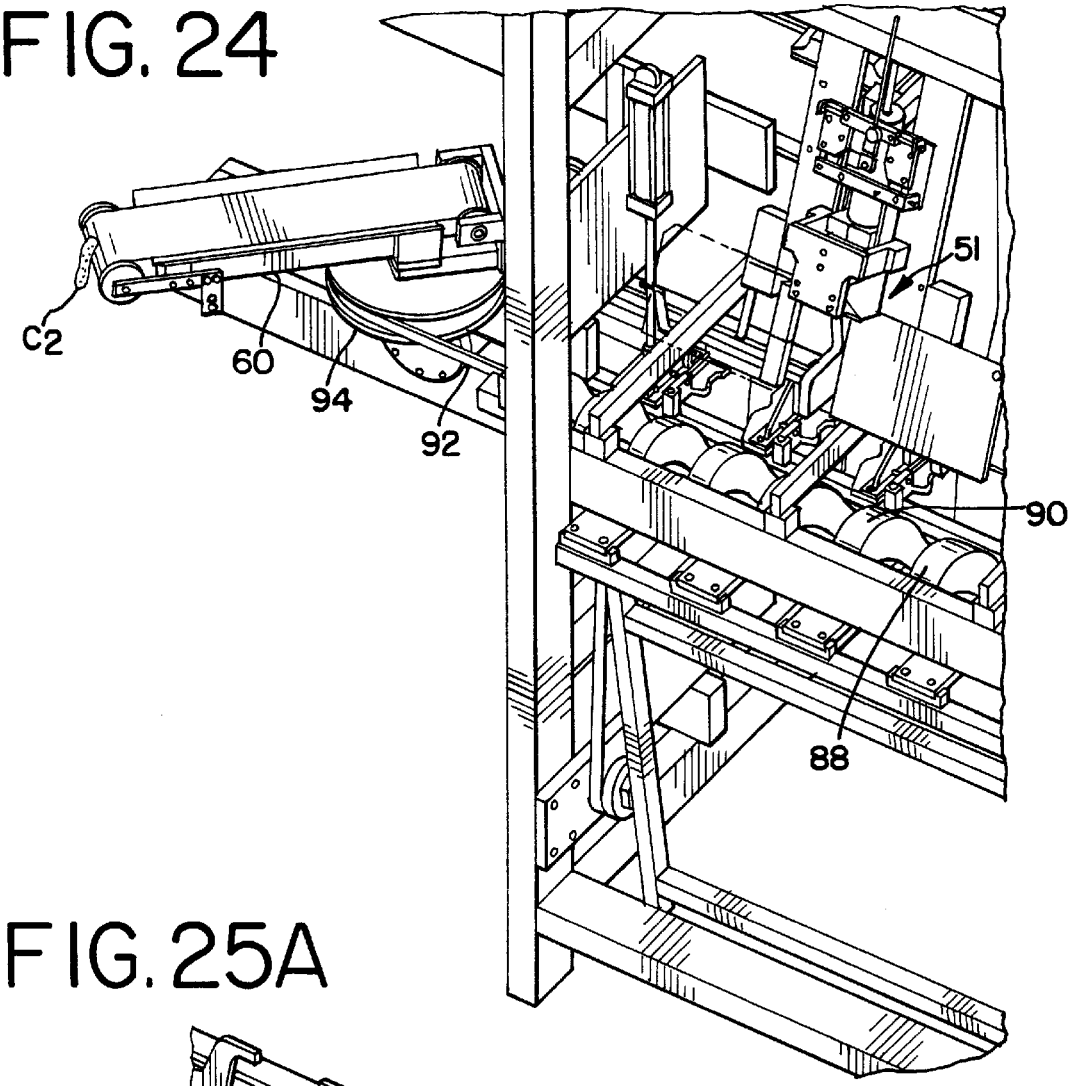

As shown in FIGS. 8–11, the cucumber C is cut into four slices by five knives as follows. A pair of outer knives 56 are the first to encounter the cucumber as it is pushed down onto the knife blades by the pusher 52. These outer knives 56 slice the outer skin $C_2$ away from the cucumber as seen in FIG. 8. As the cucumber continues to advance, the second pair of knives 57 cut the remainder of the cucumber from which the outer skin has been removed into three slices, a thin slice, a thick slice and a thin slice. The final center knife 58 cuts the middle, thicker slice into two thin slices as the slices are further pushed down onto the knives by the cucumber pusher 52. The outer skins $C_2$ are discarded via a suitable conveyer, for example conveyor 60, as shown in FIGS. 1 and 24. The knives 56, 57 and 58 are preferably double beveled for straight, easy guiding of the cucumber during slicing and may be either straight or corrugated to form smooth cut or ripple cut slices.

Figure 11:
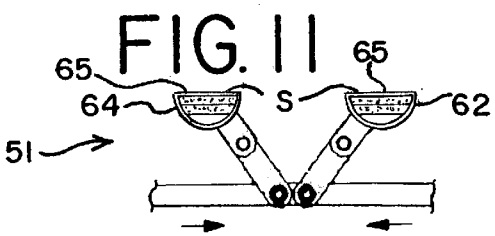
Figure 9:
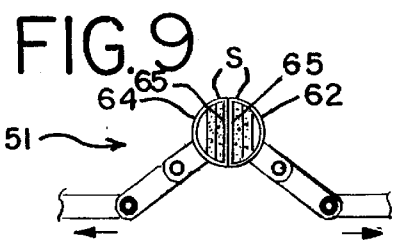

When slicing is complete, the cucumber pusher 52 continues to force the slices S past the knives and into a pair of second receptacles. These second receptacles preferably comprise a pair of pivot chutes 62 and 64, as best seen in FIGS. 8 and 9, each of which is covered by a wall 65, as best seen in FIGS. 8, 9 and 11. Once the slices S have been deposited in these pivot chute receptacles, the pivot chutes are pivoted outwardly approximately 90° into their jar or container loading positions, as shown in FIGS. 10 and 11. In the loading position, the pivot chutes 62 and 64 align with jar chutes 66 and 67, as best seen in FIG. 10, to deposit the slices into the containers. The containers or jars 70 which are to be loaded have already been positioned beneath the jar chutes 66 and 67 as will be described in the description of the jar handling section 12 to follow. Also as described to follow, the jars are elevated so that the respective jar chutes 66 and 67 are positioned adjacent the openings O of the two jars which they are to deposit slices into, as best seen in FIG. 8.

Once the jar chutes 66 and 67 have been positioned adjacent the openings O in the respective jars, the jar chutes 66 and 67 are further advanced into the respective jars by jar chute linkages 68 and 69. The jar chutes 66 and 67 are shown in FIG. 8 in the position in which they have yet to be advanced in this manner, and are shown in their fully advanced position in FIG. 10. The degree by which the jar chutes are advanced and retracted is sufficient to permit indexing of the jar between loads as will be described to follow without the jar chutes interfering with a previously deposited load, but to insure that the jar chutes are properly positioned in the jar during the deposit of a load to insure the proper positioning of that load both with respect to the jar inner wall and any previously deposited load. By way of example, the movement of the respective jar chutes 66 and 67 by the linkages 68 and 69 may be on the order of about ¾ inch. Although mechanical linkages 68 and 69 have been shown, it will be appreciated that the jar chutes may be advanced and retracted by other suitable mechanisms, such as pneumatic pistons or the like.

When the pivot chutes 62 and 64 have been positioned relative to the jar chutes 66 and 67 and the jar chutes have been positioned in the jars 70 by the linkages 68 and 69 and loading of the slices is to be commenced, load pusher pistons 71 and 72 are advanced to push the respective cucumber slices S from the respective pivot chutes 62 and 64 through the respective jar chutes 66 and 67 and into the jars 70 to load the jars, as best viewed in FIG. 10 .

From the foregoing description, it will be appreciated that for any given cucumber, half of its slices S will be deposited in one jar, and the other half in another second jar.

It will also be appreciated that although the description thus far has included the slicing of the skins $C_2$ from the cucumber and discarding those slices, and to the cutting of each of the cucumbers into four distinct slices as shown, other cutting arrangements may be employed without departing from the principles of the invention. For example, if it is desired to load the jars with cucumber halves, some of the knives may simply be eliminated and only a single knife which will cut the cucumber in half need be employed. These halves are then respectively distributed to the pair of pivot chutes 62 and 64, and one half is deposited in one of the jars and the other half in the other jar with their sliced faces facing the jar's outer wall.

An important feature of the invention is the angular relationship of the jar chutes 66 and 67 to the jar axes a and jar openings O. As shown in FIG. 7 this angle a is preferably about 60–75° to the jar opening O.

Thus, the slices S as they are being loaded into the jars as viewed in FIG. 7, pass across the jar opening 0 and across the axis a of the jar at a substantial angle to each and in a manner so that bending and possible damage to the slices is minimized. However, any bending that might occur is about the side of the cucumber which best accepts bending. For example, if cucumber halves are being loaded, bending would be about the skin side of the cut cucumber which would be the side most accepting of compression without breakage, and any tension forces would be on the flat sliced face of the cut cucumber slices which is most accepting of tension forces without breaking. Once the slices have entered the jar, this angle of entry also will ensure that the flat sliced faces will be positioned firmly against the outer wall of the jar to permit easy viewing and inspection by the consumer and assure the ability to obtain maximum loading capacity of the jar.

It will also be appreciated that in order to completely load the entire outer wall of the jar, more than one loading sequence will be necessary and that it will also be necessary to somehow rotate the jar in an indexed fashion to receive the next load of slices and hold the previously deposited load of slices in their position during indexing and subsequent deposits. This is accomplished by a mandrel 74 which is mounted to each of the jar chute frames 75, as best seen in FIG. 7. The mandrels 74 extend into each of the jars 70, as best seen in FIGS. 7 and 12–23, and remain there and do not move in and out of the jars as the jar chutes 66 and 67 are operated by the linkages 68 and 69.

The mandrel 74 comprises a core 76 which is rotatable about a vertically extending axle 78, the latter of which is attached to the jar chute frame 75 as previously discussed and as shown in FIG. 7. The core 76, as best seen in FIGS. 12–23, is mounted to rotate about the axle 78 with the previously deposited slices S as shown in FIGS. 12–17 or cucumber halves $C_3$ as shown in FIGS. 18–23. The mandrel 74 has the purpose of holding the previously deposited slices S or halves $C_3$ against the outer wall of the jar as the jar is indexed to prepare for the next deposit of cut cucumber slices or halves as will be described to follow.

Figure 12:
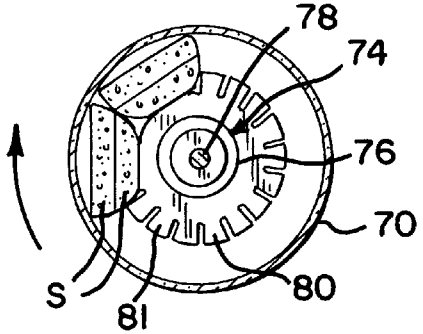

In order to perform this holding function, the mandrel 74 may take any one of a number of constructional forms, several preferred embodiments being shown in FIGS. 12–23. In the embodiment shown in FIGS. 12 and 13, a flexible membrane 80 may be spaced about half way over the height of the core 76. The membrane 80 extends laterally outwardly from the core and include slit fingers 81, as best seen in FIG. 12, which bear against the previously loaded slices S to urge them outwardly against the outer wall of the jar 70. The membrane 80 is formed of a suitable, resilient, long wearing polymer, such as polyurethane film. The core 76 may also be formed of a suitable but more rigid polymer such as Delrin. The core is preferably formed in an upper and lower piece and the pieces are fixed together with the membrane 80 sandwiched between the pieces.

Figure 14:
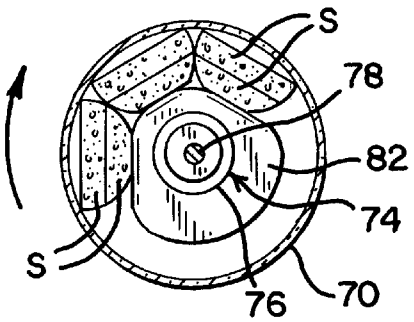
Figure 15:
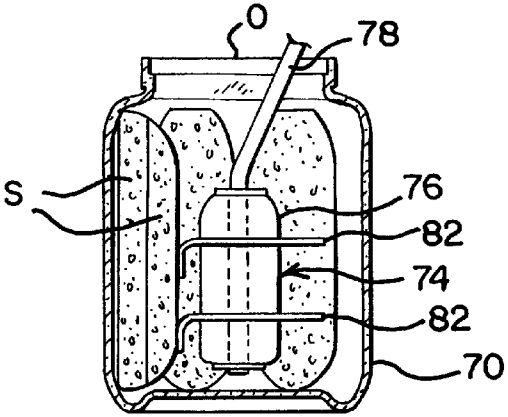
Figure 13:
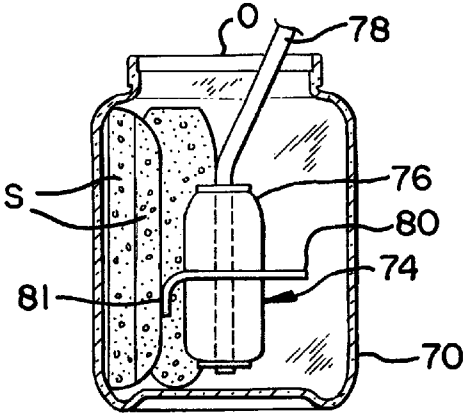

In the embodiment shown in FIGS. 14 and 15, a pair of vertically spaced, flexible membranes 82 are also shown which extend outwardly from the core 76, but which, unlike the membranes in FIGS. 12 and 13, do not include fingers.

Figure 16:
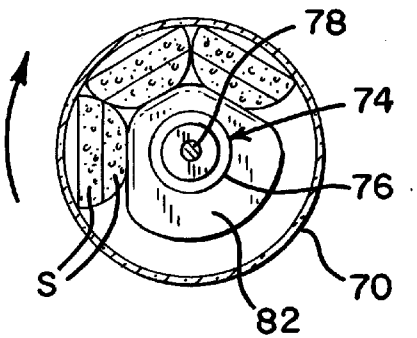
FIGS. 12–23 are partially broken, plan and elevation views showing a jar being loaded and several preferred embodiments of mandrel for maintaining the previously loaded cut cucumber pieces in position at the outer wall of the container, and while the container is being rotationally indexed to receive another load.
Figure 17:
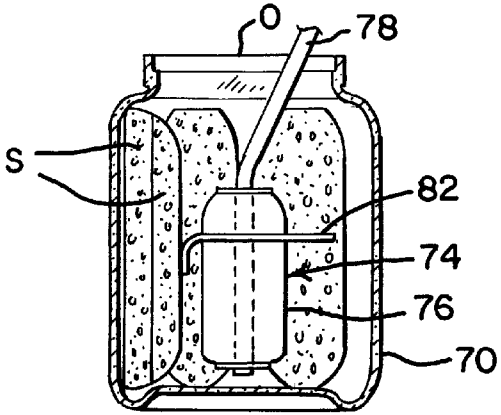

In the mandrel embodiment shown in FIGS. 16 and 17, only a single membrane 82 of a suitable resiliency is shown extending outwardly from the core 76.

Figure 18:
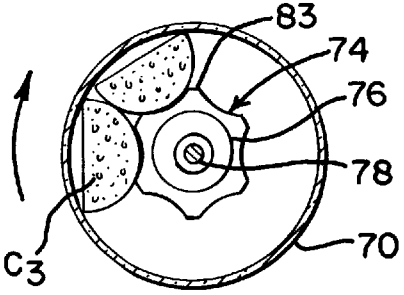
Figure 19:
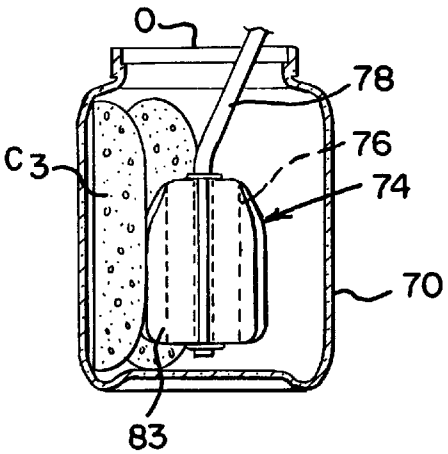

In the mandrel embodiment shown in FIGS. 18 and 19, a plurality of wings 83 extend radially outwardly from the core 76 and into between the cucumber halves $C_3$.

Figure 20:
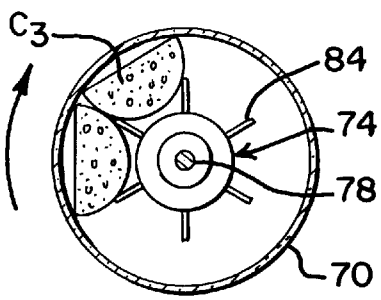
Figure 21:
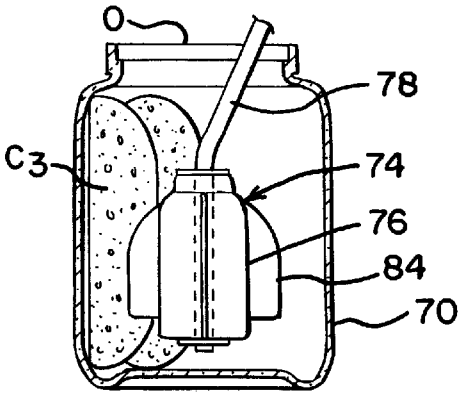

In the embodiment shown in FIGS. 20 and 21, wings 84 of a somewhat different form are formed on the core 76 to extend outwardly between the cucumber halves $C_3$.

Figure 22:
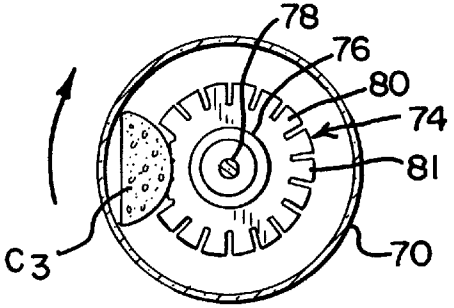
Figure 23:
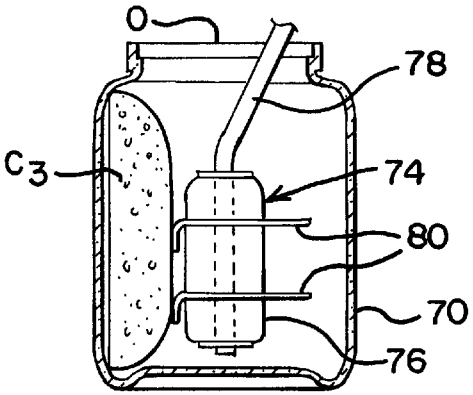

In the embodiment shown in FIGS. 22 and 23, one or more outwardly extending membranes 80 are mounted to the core 76 as previously described with respect to FIGS. 12 and 13. The membranes 80 also are preferably formed with the fingers 81 which bear against the cucumber halves $C_3$ as shown to urge the halves toward the outer wall of the jar 70. For illustration purposes only, FIGS. 12–17 illustrate the loading of cucumber slices S into the jars 70, and FIGS. 18–23 illustrate the loading of cucumber halves $C_3$ into the jars.

Referring again to FIGS. 8 and 10, the jar chutes 66 and 67 also preferably include a pair of spring fingers 86 which extend between the previously loaded slices or halves in the jar to ensure that a space is created for the next slices S or halves $C_3$ to be loaded.

The Jar Handling Section

The jar handling section 12 of the assembly and its operation is shown in FIGS. 24, 25A–25B, 26A–26F and 27. In the jar handling section 12, the empty jars are positioned, elevated so that the mandrel 74 extends through the jar opening O and into the jars for loading of the cut cucumbers, and the jar chutes 66 and 67 are positioned at the jar openings as shown in FIG. 8 so that they may be advanced into the jars by the jar chute linkages 67 and 68, as seen in FIG. 10. Also, the loaded jars are removed from the assembly in the jar handling section 12.

Figure 25A:
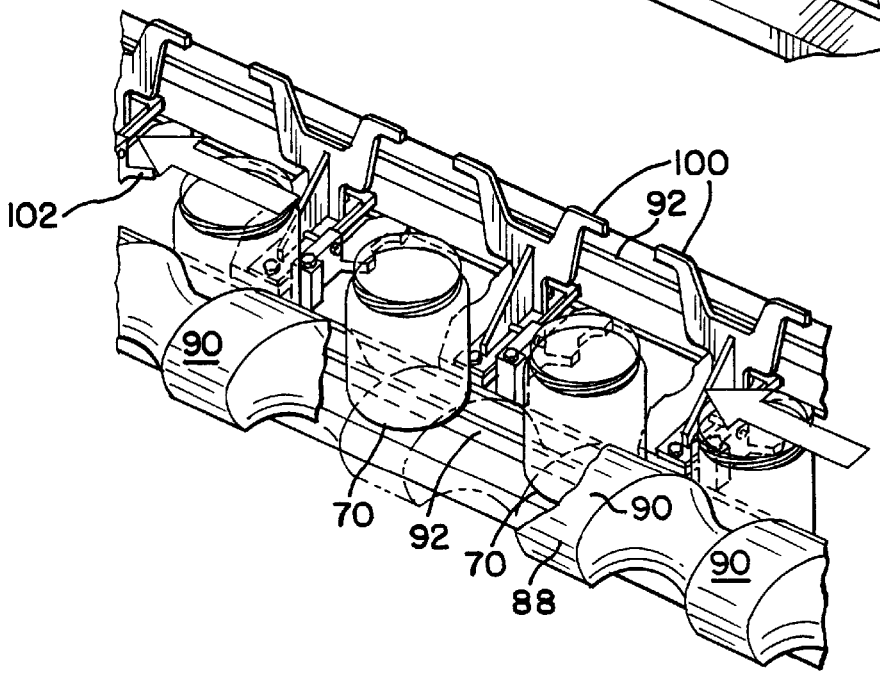
Figure 25B:
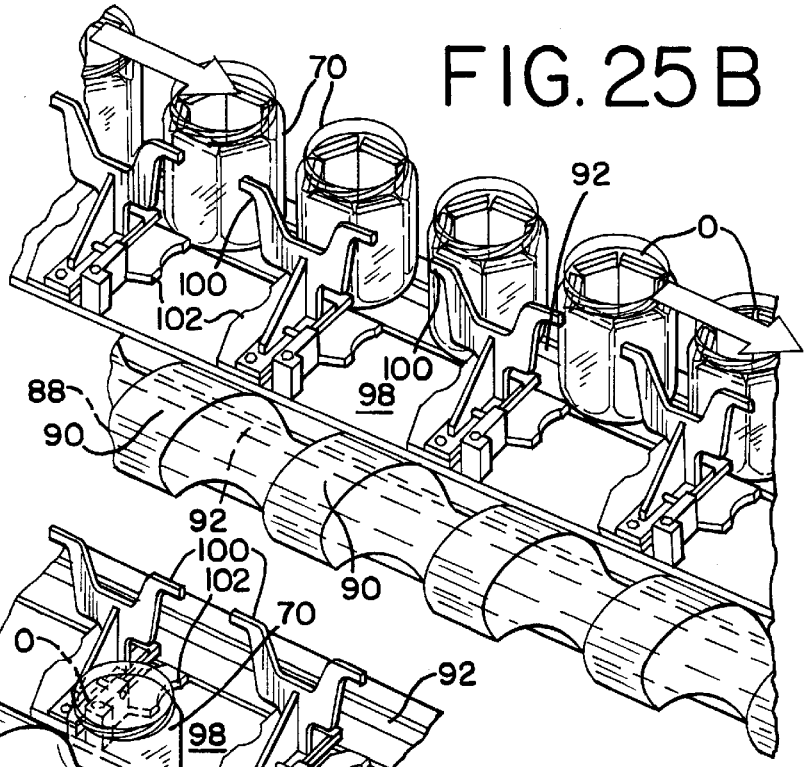

As best seen in FIGS. 24 and 25A–25B, a screw conveyor 88 feeds jars 70 to the several cutter and loader station 51 positions in the cutting and depositing section 11 of the assembly. As the screw conveyor 88 rotates, it traps a jar 70 between a pair of adjacent flights 90 of the conveyor and advances the respective jars in the direction of the arrow shown in FIG. 25A until a pair of jars 70 are positioned at each of the cutter and loader stations 51. An endless belt 92 is also located beneath each of the jars, as best seen in FIGS. 25A–25B. The bottoms of the empty incoming jars 70 rest upon the endless belt 92 as the screw conveyor 88 is advancing the jars and the belt 92 assists the screw conveyor to move the empty jars into position at the respective cutter and loader stations 51.

The endless belt 92 passes about a pulley 94, as best seen in FIG. 24, and returns through the jar handling section 12 on the side opposite from the screw conveyor 88, as shown in FIG. 25B. The jars 70 after they have been fully loaded are moved so that they are positioned on top of the return flight of the endless belt 92 and are conveyed from the assembly by that endless belt 92 in the direction shown by the arrows in FIG. 25B. The pulley 94 may either be a drive or idler pulley, and if the latter, a separate drive pulley and assembly (not shown) is located at the opposite end of the endless belt 92.

Figure 26A:
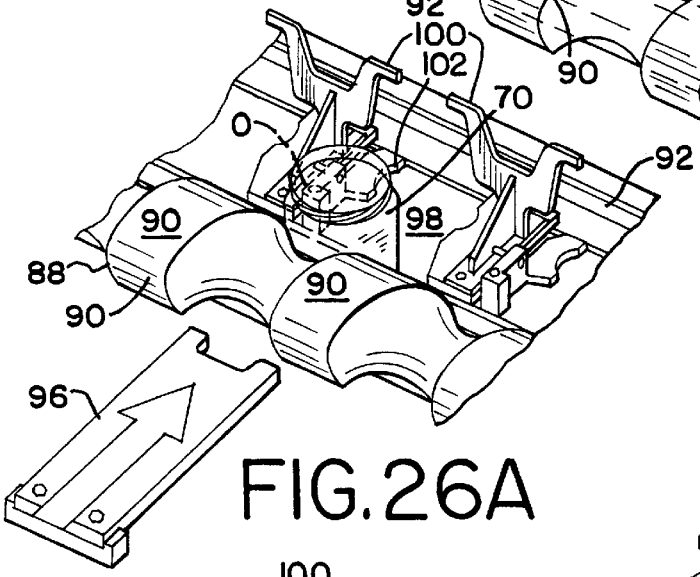
Figure 26B:
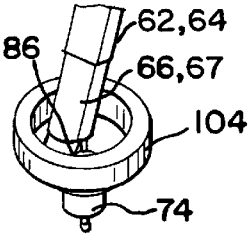
Figure 26B:
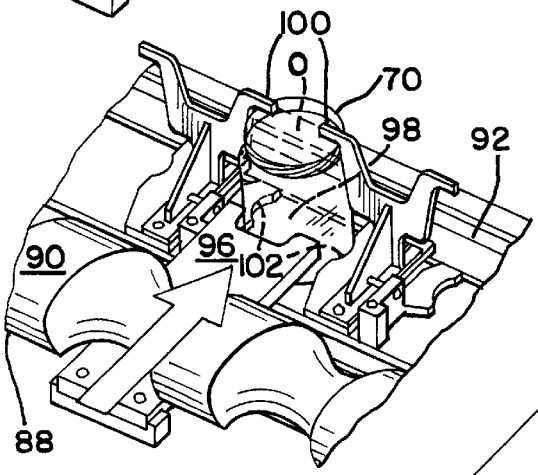

Once pairs of the jars have been properly moved into position by the screw conveyor 88 at each of the cutter and loader stations 51, the screw conveyor 88 and endless belt 92 are stopped, and a plurality of spaced side transfer pushers 96 are simultaneously activated, preferably pneumatically, to extend beneath the screw conveyor and push each of the prepositioned empty jars 70 in the direction as shown in FIGS. 26A and 26B. This will position the empty jars 70 on a jar elevator 98 beneath stripper fingers 100 on the elevator 98 and between jar side guides 102. The jar side guides 102 ensure the proper positioning of the jar for loading, and the stripper figures will pull the jar away from the loading assembly once the jar has been loaded.

Figure 26C:
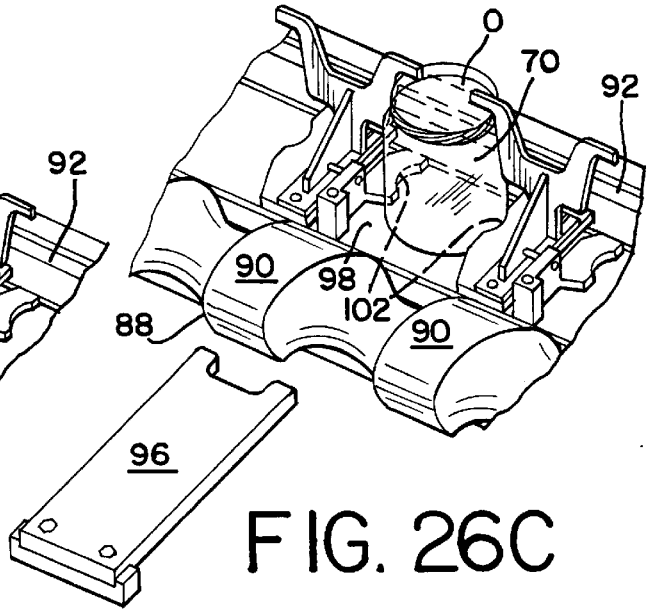

Once the jars 70 have been positioned on the jar elevator 98 beneath the stripper fingers 100 and between the side guides 102, the side transfer pusher 96 is retracted, as shown in FIG. 26C, and the jar elevator 98 is elevated, as shown by the arrows in FIG. 26D, to elevate the jars toward the jar chutes 66 and mandrels 74.

When elevated, a mandrel 74 will be positioned in each jar and a jar chute 66 or 67 will be positioned relative to the opening O of the jars, as previously described and as shown in FIG. 8. At this point the jar chute linkages 68 and 69 are activated, also as previously described, to advance the ends of the jar chutes 66 and 67 into the jars, as shown in FIGS. 10 and 26D, to commence loading of the cut cucumbers. Once the elevator 98 has been elevated, the screw conveyor 88 and endless belt 92 may again be operated to position another set of jars adjacent the cutter and loader stations 51 for the next jar loading sequence.

Each of the cutter and loader stations 51 also includes a positioning collar 104 which fits over the opening O of each jar when it is elevated to its loading position, as shown in FIG. 26D. Collar 104 assists in steadying the jar against lateral or other displacing forces exerted upon it during the loading operation to assure uniformity of slice placement in the jar during each loading step and the uniformity of the overall load. Also as shown in FIG. 26D, loading of the cut cucumbers or slices into the jar through the respective jar chutes 66 and 67 as previously described will now proceed as shown by the arrows on the jar chute in FIG. 26D. As each set of cut cucumbers or slices is loaded into the jar, a space for the load being inserted is ensured by the resilient fingers 86 on the jar chutes 66 and 67, as seen in FIGS. 8, 10 and 26D. As a load of slices is loaded into the jar, as well as any prior loads, the loads will be held against the outer wall of the jar 70 by the membrane 80 on the mandrel 74, and the jar will be rotationally indexed in the direction of the large arrow in FIG. 27 following each load. This rotational indexing will be described in more detail to follow.

Once the jar 70 has been loaded with the number of sets of cut cucumbers or slices which are to be loaded in the jar, for example six sets as shown in FIGS. 26E–F, the jar elevator 98 is lowered with the jars that have been loaded, as shown in FIG. 26E. When the elevator 98 has been fully lowered, the side transfer pusher 96 is again actuated to push a fresh empty jar 70 toward the filled jar on the lowered jar elevator 98. This will displace the fully loaded jar 70 to the right, as viewed in FIG. 26F, and off of the lowered jar elevator 98, and the new empty jar 70 will now be positioned on the jar elevator 98 beneath the stripper fingers 100 and jar side guides 102 in the same manner as the now fully loaded jar was when it was positioned on the jar elevator prior to loading, as previously described.

The sequence is again repeated by withdrawing the side transfer pusher 96, as seen in FIG. 26C, and elevating the jar elevator 98, as shown by the arrows in FIG. 26D. As previously discussed, once the jar elevator 98 is elevated to the position shown in FIG. 26D to commence loading of the next group of jars, the screw conveyor 88 and endless belt 92 are again actuated. Actuation of the screw conveyor 88 and endless belt conveyor 92 will accomplish two things. As previously described, one is to deliver another set of empty jars for loading once the jar elevator 98 has been lowered. The other is that the outer flight of the endless belt conveyor 92 will convey the jars which have just been loaded from the assembly in the direction of the arrows as shown in FIG. 25B.

Also as previously discussed, during loading each of the jars is rotationally indexed following the deposit of each load of cut cucumbers into the jar 70. For example where loading comprises the deposit of six sets of slices as shown in the drawings, the jars are rotationally indexed 1/6th of a revolution after each deposit of cucumbers from the jar chutes 66 or 67, and after the jar chutes have been withdrawn from the jars to the position seen in FIG. 8 by the linkages 68 and 69.

When the jar elevator 98 is elevated to move the jars 70 into the loading position, the elevated condition of the elevator is sensed by suitable proximity switches or the like (not shown). With particular reference to FIG. 27, jar rotation is controlled by a pair of drive wheels 106 and 108. Each drive wheel includes a resilient o-ring 110 which projects from its perimeter and into contact with the side of the jar 70 to frictionally engage the jar for rotation. The drive wheels 106 and 108 in turn are driven by a resilient toothed belt 112 which engages complimentary teeth (not shown) on a drive spindle for each of the drive wheels to cause the wheel to rotationally index. A load wheel 114 also contacts the side of the jar 70 opposite the drive wheels 106 and 108 and idles as the jar is rotated to hold the jar against the drive wheels to increase traction between the drive wheels and the jar. The load wheel 114 is preferably spring loaded against the jar by a spring (not shown) to compensate for variations in the diameter of the glass and jar.

Description of Operation

From the foregoing description of the preferred embodiment of assembly and method of the present invention, it is believed that the operation of the preferred embodiment of the present invention will be readily apparent to those skilled in the art. However, to ensure full clarity and understanding of the present invention, a brief sequential description of the preferred operation will follow.

Prior to commencing that description, it will be assumed for purposes of the description that the assembly will contain nine cutter and loader stations 51 and that six loads of cut cucumbers will constitute a complete loading of one jar 70 by the assembly and method of the invention. Because each cutter and loader station 51 will simultaneously deposit loads into jars at the same time, a given slice cutter and loader station 51 will handle six cucumbers per cycle and will fill two jars per cycle with a total of twelve loads from the six cucumbers. Also, because of the nine cutter and loader stations 51, eighteen jars will be loaded per cycle and a total of fifty-four cucumbers will be processed per cycle.

It will of course be understood that these numbers are given by way of example only and that the present invention may be employed with greater or lesser numbers of cutter and loader stations 51 than the nine mentioned and greater or lesser numbers of deposits per jar that the six described.

Referring to FIGS. 1–4, cucumbers are loaded into each of the pockets 18 on the continuously moving conveyor 14. For the nine cutter and loader stations 51 and the total of six loads per jar, fifty-four cucumbers C would be loaded on conveyor 14. When loading the cucumbers, which may be performed by machine (not shown) or manually by production line personnel, one end of each of the cucumbers C is brought to bear against the guide rail 20 to establish a reference for length sizing of the cucumbers.

The conveyor 14 then continuously conveys the cucumbers C to the right, as viewed in FIGS. 2–4, and into the cut-to-length slicer 22 as shown by the arrow in FIG. 4. As each cucumber C passes the angled knife 26 in the slicer, if it is oversized in length, it will be trimmed as shown in FIG. 4, with the trimmings $C_1$ being discarded from the system via the scrap chute 28.

Following trimming to length, the fifty-four cucumbers C will continue to the right as viewed in the drawings from the cut-to-length slicer 22. The staging shuttle 34 will also move to the right until the shuttle 34 and conveyor are in alignment with each other and their speeds match. At this time, the transfer pusher 40, which also is moving with the conveyor, is activated so that its fingers 42 laterally push each of the fifty-four cucumbers into the fifty-four respective pockets of the staging shuttle 34, as seen in FIGS. 6B and 6C. Once the cucumbers C have all been transferred to the pockets 38 of the staging shuttle 34, the transfer pusher 40 is rotated as shown in FIG. 6C, and returns to its initial position, as shown in FIG. 6D, in readiness for the receipt of another load of cucumbers on the conveyor 14.

At this point the staging shuttle 34 stops and the kicker transfer 44 is activated to move downwardly as shown by the arrow in FIG. 5. When the fingers 46 have been vertically positioned behind the cut ends of each of nine of the cucumbers, its nine fingers 46 are rotated, one for each cutter and loader station 51, to kick nine cucumbers C from the staging shuttle 34 to nine respective tip-ups 48, two of which are shown in FIGS. 6D and 6E. Once the nine cucumbers have been transferred to the nine tip-ups 48, the kicker transfer 44 is rotated back to its initial position, as seen in FIG. 6E, and the staging shuttle 34 is advanced to the left as shown by the arrow in FIG. 6E by one pocket 38 so that the next nine cucumbers are positioned in alignment with their respective tip-ups 48 in readiness for transfer to the tip-ups when the tip-ups are available to receive the next cucumbers, as shown in FIGS. 6F and 6G.

The tip-ups 48 mark the entry of the cucumbers C to the cutting and depositing section 11, as shown in FIG. 1. With particular reference to FIGS. 7 and 8, the tip-up 48 at each cutter and loader station 51 with the cucumber therein is pivotally tipped, so that it is in axial alignment with the cut tube 54 and its knives and the cucumber pusher 52. When this alignment is achieved, the pusher 52 pushes on the trailing end of the cucumber C to move the cucumber from the tip-up 48 into and through the knife frame 54 and past its knives 56, 57 and 58, as seen in FIG. 8. As shown in the drawings, the cut cucumbers to be deposited in the jars are shown and will be described as plural slices, although it will be appreciated that the cut cucumbers may take other forms such as the cucumber halves as shown in FIGS. 18–23. Where slices are to be deposited as shown in the drawings, when the cucumber is pushed down onto the pair of outer knives 56, as best seen in FIG. 8, the outer skin $C_2$ is sliced away and discarded to a conveyor 60 for discard, as shown in FIGS. 1 and 24. As the cucumber C is pushed further, the second pair of knives 57 cut the cucumber into three slices, two outer thin slices and one central thick slice. The center knife 58 then cuts the central, thicker slice into two thin slices.

The cucumber pusher 52 will continue to push the slices S from the cut tube 54 and, as shown in FIGS. 8 and 9, will deposit two of the slices in pivot chute 62, and the other two slices in pivot chute 64. At this point, each of the pivot chutes 62 and 64 is separated from each other by their respective walls 65.

At this time, the jar chutes 66 and 67 are further advanced by the jar chute linkages 68 and 69 into the respective empty jars which are to be loaded with the slices, and which already have been positioned in the cutter and loader stations 51 as will be described to follow. The jar chutes 66 and 67 are advanced from the position shown in FIG. 8 to the position shown in FIGS. 7 and 10.

The cucumber pusher piston 52 is retracted in readiness for the next cucumber and the pivot chutes 62 and 64 may be pivoted outwardly now that the jar chutes 66 and 67 have been advanced into the jars. The pivot chutes 62 and 64 are pivoted outwardly approximately 90°, as shown in FIGS. 10 and 11, and so that they are in alignment respectively with the pair of jar chutes 66 and 67 which have already been advanced into the jars in readiness for loading. The respective pairs of cucumber slices S which are still in their respective pivot chutes 62 and 64 are now ready for deposit into two respective jars 70.

The operation of the jar handling section 12 as seen in FIG. 1 will now be described, including its positioning of the jars to receive successive deposits of cucumber slices from the jar chutes 66 and 67.

Referring to FIGS. 24 and 25A, eighteen empty jars 70, two for each of the nine cutter and loader stations 51, are moved, as shown by the arrow in FIG. 25A, by the screw conveyor 88 and incoming flight of the endless belt 92. Once these eighteen empty jars have been positioned two at each of the cutter and loader stations 51, the screw conveyor 88 and endless belt 92 are stopped. The eighteen side transfer pushers 96 are now simultaneously actuated to move in the direction of the arrows, as seen in FIGS. 26A and 26B, to push an empty jar 70 onto the jar elevator 98 beneath the stripper fingers 100 and between the jar side guides 102, as seen in FIG. 26B. Once the eighteen empty jars 70 are positioned on the jar elevator 98, the side transfer pushers 96 are retracted, as seen in FIG. 26C, and the jar elevator 98 is elevated with the eighteen empty jars 70 on it. This will position the eighteen empty jars, two at each cutter and loader stations 51, for loading of the jars. When so positioned as shown in FIG. 26D, each of the eighteen empty jars are positioned in the positioning collar 104 at each of the eighteen jar chutes 66 and 67 of the nine cutter and loader stations 51. In this position, the jar chutes 66 and 67 are positioned at the opening O of the jars, as seen in FIG. 8, and the jar chutes will now be advanced as previously described by the jar chute linkages 68 and 69 to extend into the openings, as seen in FIGS. 10 and 26D. At this time, the jar chutes 66 and 67 extend at an angle of about 60–75° to the plane of the jar openings O and toward the outer wall of the respective jars 70, as seen in FIG. 7. This minimizes breakage of the cucumber slices during loading, and permits an optimum tight pack of the slices in the jar with the cut faces of the slices readily visible through the exterior of the jar and to the consumer.

Elevation of the jar elevator 98 to position the empty jars for loading also results in the positioning of the mandrel 74 of each jar chute into each jar, as shown in FIG. 8 and any one of the FIGS. 12–23, and without regard to whether the jar chutes 66 and 67 have been advanced into the jars.

Loading is commenced by activating the load pusher pistons 71 and 72, as viewed in FIGS. 7 and 8, to push the slices S from the respective pivot chutes 62 and 64 through the jar chutes 66 and 67 and so as to deposit that load of slices into the respective pair of jars 70 at each cutter and loader station 51 and against the outer wall of the respective jars, as seen in FIG. 26D.

Once a load has been deposited in the jar, each of the jar chutes 66 and 67 is retracted by the linkages 68 and 69 to ensure that the spring fingers 86, as seen in FIGS. 8 and 10, do not interfere with any of the already deposited loads as the jar is rotationally indexed to receive the next load. Each of the jars 70 is then rotationally indexed by the drive wheels 106 and 108 against the load wheel 114, as shown in FIG. 27, for ⅙th of a turn where the system is designed for the deposit of six loads per jar. As the jars 70 are indexed, the membrane 80 on the mandrel 74, which is not retracted with the jar chutes 66 and 67, bears against the previous loads which have been deposited in the jar and the membrane and core 76 will rotate with the jar and the previous loads to hold the previous loads in their position against the outer wall of the jar, as shown in FIGS. 12–23.

When indexing has been completed and the jar is ready for the next load, the jar chutes 66 and 67 are again advanced into the jars by the jar chute linkages 68 and 69 as previously described, and the next load will be deposited employing the procedural steps last described. The resilient fingers 86 on the respective jar chutes 66 and 67 ensure sufficient spacing of the previously deposited loads to make room for the next load to be deposited.

Once loading of the jars has been completed, the jar elevator 98 will be lowered with the loaded jars, with the stripper fingers 100 ensuring that the now loaded jars are readily separated from the positioning collar 104 and the mandrel 74. When the jar elevator 98 has been fully lowered, the side transfer pushers 96 are again actuated, as shown in FIG. 26E, to push a new empty jar onto the jar elevator 98 which will displace the already loaded jar from the elevator and onto the endless belt 92, as seen in FIG. 26F.

The jar elevator 98 is again elevated to repeat the loading cycle for the next load of jars. When elevated, the screw conveyor 88 and endless belt 92 are again actuated to deliver another set of eighteen empty jars, as shown in FIG. 25A. The operation of the endless belt 92 and its return flight at this time will also convey the previously filled eighteen jars from the assembly, as shown in FIG. 25B.

In the foregoing description, the loading which has been described is of the cut cucumber pieces around the outer wall. If any further loading of the center of the jar is needed, such loading will either be accomplished manually or by a machine other than described herein after the jars which have been loaded by the assembly of the invention have been removed from the assembly.

From the forgoing, it will be appreciated that the present invention is capable of efficiently and effectively processing cut cucumbers for pickles and mechanically and automatically depositing the cut cucumbers in jars for further handling, while minimizing the expensive manual manipulation of the cucumbers and damage to the cucumbers, and maximizing the quality and effectiveness of packing of the cut cucumbers.

It will also be understood that the preferred embodiments of the present invention which have been described are merely illustrative of the principles of the present invention. Numerous modifications may be made by those skilled in the art, without departing from the true spirit and scope of the invention.

We claim:

1. A method of loading elongated articles of food into a container comprises:

positioning an elongated article of the food in a first receptacle;

longitudinally moving the article from said first receptacle into and past at least one knife to slice the article over its length into at least two pieces, and to urge the sliced pieces beyond the knife and into a pair of second elongate tubular receptacles such that the sliced pieces are divided between the second receptacles, said second receptacles being axially aligned with the first elongate receptacle during slicing of the article of food;

moving said pair of second receptacles with the sliced pieces therein apart from each other and to a position in which each of the respective second receptacles with the sliced pieces therein is aligned with an opening in one of a pair of the containers which are to be loaded; and longitudinally moving the sliced pieces from their respective second receptacles into each of the respective containers to deposit the sliced pieces from one of the second receptacles into one of the containers and the sliced pieces from the other of the second receptacles into the other of the containers.

2. The method of claim 1, including exerting a force on the end of the article of food opposite the end that is moved into the knife to move the article into and beyond the knife.

3. The method of claim 1, wherein the article of food is moved past a plurality of knives to form a plurality of slices, and wherein half of said slices are urged into one of said second elongate receptacles, and the remaining half of the slices are urged into the other of said second elongate receptacles.

4. The method of claim 3, including slicing a portion of the outer surface of the article of food from the food and discarding it prior to urging the slices into their respective containers.

5. The method of claim 1, including slicing a portion of the outer surface of the article of food from the food and discarding it prior to urging the slices into their respective containers.

6. The method of claim 1, wherein when the sliced pieces are urged into said pair of second receptacles, the receptacles are positioned adjacent each other and when the receptacles are moved apart, they are pivoted about 90° from each other.

7. The method of claim 1, wherein when each of the sliced pieces is moved from its respective second receptacles into each of its respective containers, it is moved at a substantial angle both to the axis of the container and to the opening of the container and toward the outer wall of the container.

8. The method of claim 7, wherein said angle relative to the opening of the container is about 60–75°.

9. The method of claim 7, wherein each of the sliced pieces has at least one open face thereon which is formed by the slicing, and said open face of said sliced pieces is positioned to face substantially away from the opening of the container as the sliced pieces are moving at a substantial angle to the opening of the container to permit the sliced pieces to bend as they are entering the opening and the open face to face the wall of the container after the sliced pieces have been deposited in the container.

10. The method of claim 7, including a deposit chute between each of said second receptacles and its respective container, and wherein at least one of the respective deposit chutes of each of said second receptacles and/or the containers are moved relative to each other so that each of the respective deposit chutes are positioned into its respective container prior to moving the sliced pieces from the respective second receptacles into the container, and is withdrawn from the sliced pieces following deposit of the sliced pieces in the respective containers.

11. The method of claim 1, including a deposit chute between each of said second receptacles and its respective container, and wherein at least one of the respective deposit chutes of each of said second receptacles and/or the containers are moved relative to each other so that each of the respective deposit chutes are positioned into its respective container prior to moving the sliced pieces from the respective second receptacles into the container, and is withdrawn from the sliced pieces following deposit of the sliced pieces in the respective containers.

12. The method of claim 1, wherein each of said containers is rotationally indexed about their respective axes following the deposit of the sliced pieces into the respective containers, and the previously performed steps are sequentially repeated to deposit additional sliced pieces into each of said containers and next to the previously deposited sliced pieces.

13. The method of claim 12, including holding the sliced pieces which have been deposited in each of the containers against the outer wall of the containers while the containers are being rotationally indexed.

14. The method of claim 12, including laterally moving next adjacent previously deposited sliced pieces so as to make room for subsequently deposited sliced pieces simultaneously with the deposit of the next subsequently deposited sliced pieces.

15. The method of claim 1, wherein said elongated articles of food are cucumbers.

16. The method of claim 1, including exerting a force on the end of the article of food opposite the end that is moved into the knife to move the article into and beyond the knife; wherein when the sliced pieces are urged into said pair of second receptacles, the receptacles are positioned adjacent each other, and when the receptacles are moved apart, they are pivoted about 90° from each other; wherein when each of the sliced pieces is moved from its respective second receptacles into each of its respective containers, it is moved at a substantial angle both to the axis of the container and to the opening of the container and toward the outer wall of the container; including a deposit chute between each of said second receptacles and its respective container, and wherein at least one of the respective deposit chutes of each of said second receptacles and the containers are moved relative to each other so that each of the respective deposit chutes are positioned into its respective container prior to moving the sliced pieces from the respective second receptacles into the container, and is withdrawn from the sliced pieces following deposit of the sliced pieces in the respective containers; wherein each of said containers is rotationally indexed about their respective axes following the deposit of the sliced pieces into the respective containers, and the previously performed steps are sequentially repeated to deposit additional sliced pieces into each of said containers and next to the previously deposited sliced pieces; and holding the sliced pieces which have been deposited in each of the containers against the outer wall of the containers while the containers are being rotationally indexed.

17. The method of claim 16, wherein the article of food is moved past a plurality of knives to form a plurality of slices, and wherein half of said slices are urged into one of said second elongate receptacles, and the remaining half of the slices are urged into the other of said second elongate receptacles; and slicing a portion of the outer surface of the article of food from the food and discarding it prior to urging the slices into their respective containers.

18. The method of claim 16, wherein said elongated articles of food are cucumbers.

19. A method of loading elongated articles of food into a container comprising:

slicing the article over its length into at least two pieces with a knife;

separating the sliced pieces and the knife from each other;

moving at least one of said sliced pieces across one side of an opening of a container which is to be loaded at a substantial angle both to the axis of the container and to the opening of the container, and in a diagonal direction toward the outer wall of the container opposite said one side of the opening to deposit said at least one of said sliced pieces into said container at said outer wall opposite said one side of the opening.

20. The method of claim 19, wherein said container is rotationally indexed about its axis following the deposit of at least one of said sliced pieces into the container, and the previously performed steps are sequentially repeated to deposit additional sliced pieces into said container.

21. The method of claim 20, including holding at least one of said sliced pieces which have been deposited in the container against the outer wall of the container while the container is being rotationally indexed.

22. The method of claim 21, wherein said elongated articles of food are cucumbers.

23. The method of the claim 21, including moving the other of said at least two sliced pieces across the opening of another container which is to be loaded and at a substantial angle both to the axis of said another container and to its opening, and in a direction toward the outer wall of said another container to deposit said other of said at least two sliced pieces into said another container, whereby some of said sliced pieces are deposited into one container and some of said sliced pieces are deposited into said another container.

24. The method of claim 19, wherein said at least one sliced piece has at least one open face thereon which is formed by the slicing, and said open face is positioned to face substantially away from the opening of the container as said sliced piece is moving at a substantial angle to the opening of the container to permit the sliced piece to bend as it is entering the opening and to face the wall of the container after it has been deposited into the container.

25. The method of claim 24, wherein said elongated articles of food are cucumbers.

26. The method of claim 19, wherein said elongated articles of food are cucumbers.

27. The method of claim 19, including moving the other of said at least two sliced pieces across the opening of another container which is to be loaded and at a substantial angle both to the axis of said another container and to its opening, and in a direction toward the outer wall of said another container to deposit said other of said at least two sliced pieces into said another container, whereby some of said sliced pieces are deposited into one container and some of said sliced pieces are deposited into said another container.

28. The method of claim 27, wherein said elongated articles of food are cucumbers.

29. The method of claim 19, wherein the angle relative to the opening is about 60–75°.

30. The method of claim 19, including moving a deposit chute and/or the container so that said chute extends through the opening and into the container, and moving said at least one of said sliced pieces through the deposit chute and into the container from the deposit chute in the container.

31. The method of claim 30, wherein the deposit chute is withdrawn from the deposited sliced pieces after the sliced pieces have been deposited therefrom into the container.

32. An assembly for loading elongated articles of food into a container, comprising:

a first elongate receptacle for receiving one of the elongated articles of food;

at least one knife associated with said first receptacle;

a pusher for pushing the article of food in said first receptacle past said knife to slice the article of food over its length into a least two pieces;

a pair of second movable elongate receptacles which are movable between a first position in which they are positioned adjacent each other and to receive each of the respective sliced pieces as they move past said knife, and a second position in which the pair of second movable elongate receptacles are spaced apart from each other;

container positioning means for positioning at least two containers with openings such that the openings of the containers are aligned with each of the respective second movable elongate receptacles when those receptacles are in their spaced apart second position; and a pusher for pushing each of the two respective sliced pieces from their respective second movable elongate receptacles into each of the respective containers to deposit the respective sliced pieces into the respective containers.

33. The assembly of claim 32, wherein said knife is positioned adjacent a discharge end of said first elongate receptacle, and said pusher for pushing the article of food past the knife is constructed and arranged to push the end of the article opposite said knife toward said knife.

34. The assembly of claim 32, comprising a plurality of knives to form a plurality of sliced pieces, and when the article of food is being sliced, said pair of second movable elongate receptacles are positioned so that one of said second movable elongate receptacles receives some of said sliced pieces and the other of said movable elongate receptacles receives the remainder of said sliced pieces.

35. The assembly of claim 34, including a knife for slicing a portion of the outer surface of the article of food from the food, and means for diverting the sliced portion of the outer surface from said second movable elongate receptacles.

36. The assembly of claim 32, wherein said second movable elongate receptacles are pivoted about 90° from each other when they are moved between said first and second positions.

37. The assembly of claim 32, including a deposit chute between each of said second movable elongate receptacles and its respective container when said second receptacles are in said second position, and means for moving said chute and/or its container relative to each other so that said chute extends into the opening of its container for the deposit of the sliced pieces into the container and said chute is withdrawn from the deposit of the sliced pieces following deposit.

38. The assembly of claim 37, wherein said deposit chutes extend at a substantial angle both to the axis of the container and to the opening of the container and toward the outer wall of the container which has been positioned for deposit of the food and when said second movable elongate receptacles have been positioned in said second position.

39. The assembly of claim 38, wherein said angle relative to the opening of the container is about 60–75°.

40. The assembly of claim 32, including indexing means for rotationally indexing the containers about their respective axes following the deposit of the sliced pieces into the respective containers to permit the subsequent deposit of additional sliced pieces into each of the containers.

41. The assembly of claim 40, including resilient fingers for laterally spacing previously deposited sliced pieces from sliced pieces which are subsequently being deposited next adjacent to the previously deposited sliced pieces.

42. The assembly of claim 40, including a mandrel which extends into each container during the deposit of sliced pieces into the container, and which is constructed and arranged to hold the sliced pieces against the outer wall of the container as the container is being indexed.

43. The assembly of claim 40, wherein said mandrel comprises a core having a plurality of wings extending substantially parallel to the core and to the axis of the container into which the mandrel extends.

44. The assembly of claim 42, wherein said mandrel comprises a core and at least one flexible member which extends at a substantial angle from the core and to the axis of the container into which the mandrel extends, and the flexible member contacts the sliced pieces which have been deposited in the container to urge the deposited sliced pieces toward the outer wall of the container.

45. The assembly of claim 44, wherein said flexible member comprises a plurality of flexible fingers which contact the sliced pieces which have been deposited in the container.

46. The assembly of claim 32, wherein said knife is positioned adjacent a discharge end of said first elongate receptacle, and said pusher for pushing the article of food past the knife is constructed and arranged to push the end of the article opposite said knife toward said knife; wherein said second movable elongate receptacles are pivoted about 90° from each other when they are moved between said first and second positions; including a deposit chute between each of said second movable elongate receptacles and its respective container when said second receptacles are in said second position, and means for moving said chute and its container relative to each other so that said chute extends into the opening of its container for the deposit of the sliced pieces into the container and said chute is withdrawn from the deposit of the sliced pieces following deposit; wherein said deposit chutes extend at a substantial angle both to the axis of the container and to the opening of the container and toward the outer wall of the container which has been positioned for deposit of the food and when said second movable elongate receptacles have been positioned in said second position; indexing means for rotationally indexing the containers about their respective axes following the deposit of the sliced pieces into the respective containers to permit the subsequent deposit of additional sliced pieces into each of the containers; and a mandrel which extends into each container during the deposit of sliced pieces into the container, and which is constructed and arranged to hold the sliced pieces against the outer wall of the container as the container is being indexed.

47. The assembly of claim 37, including spring means on said deposit chute for spacing of the previously loaded sliced pieces for deposit of the next sliced pieces and guiding the next sliced pieces during deposit.

48. The assembly of claim 47, wherein said spring means its metal.

49. A method of loading elongated articles of food into a container comprising:

positioning an elongated article of the food in a receptacle;

longitudinally moving the article from said receptacle into and past at least one knife to slice the article over its length into at least two pieces, and to urge the sliced pieces beyond the knife and at least one sliced piece into at least one deposit chute, said deposit chute being axially aligned with said receptacle during slicing of the article of food;

moving said deposit chute and/or the container so that said chute extends through an opening in the container which is to be loaded and into the container;

moving the sliced piece from said deposit chute into the container to deposit the sliced piece from said deposit chute into the container into which it has been positioned; and withdrawing said deposit chute from the deposited sliced piece.

50. An assembly for loading elongated articles of food into a container, comprising:

a first elongate receptacle for receiving one of the elongated articles of food;

at least one knife associated with said first receptacle;

a pusher for pushing the article of food in said first receptacle past said knife to slice the article of food over its length into at least two pieces;

a second elongate receptacle positioned to receive at least one of the sliced pieces as they move past said knife;

container positioning means for positioning at least one container with an opening such that the opening of the container is aligned with said second elongate receptacle;

a deposit chute between said second elongate receptacle and said container;

means for moving said chute and/or said container relative to each other so that said chute extends into the opening of said container for the deposit of said at least one of the sliced pieces into said container and said chute is withdrawn from the deposited sliced piece following deposit, and a pusher for pushing said at least one of the sliced pieces from said second elongate receptacle through said deposit chute and into said container to deposit said at least one of said sliced pieces into said container.

51. The assembly of claim 50, wherein said deposit chute extends at a substantial angle both to the axis of said container and to the opening of said container and toward the outer wall of said container which has been positioned for deposit of the food.

52. The assembly of claim 51, wherein said angle relative to the opening of said container is about 60–75°.

53. The assembly of claim 50, including spring means on said deposit chute for spacing of the previously loaded sliced pieces for deposit of the next sliced pieces and guiding the next sliced pieces during deposit.

54. The assembly of claim 53, wherein said spring means its metal.

* * * * *

UNITED STATES PATENT AND TRADEMARK OFFICE

CERTIFICATE OF CORRECTION

PATENT NO. : 6,079,191 
DATED : June 27, 2000
INVENTOR(S) : Zbigniew S. Borkiewicz, Tod W. Heleniak and Larry E. Daane It is certified that error appears in the above-identified patent and that said Letters Patent is hereby corrected as shown below:

Column 5,
Line 62, "C," should be -- $C_1$ --.

Column 7,
Line 6, "GD" should be -- 6D --.

Column 12,
Line 15, "o-ring" should be -- O-ring --.

Column 19,
Line 49, "deposit of the" should be deleted.

Signed and Sealed this

Twenty-sixth Day of August, 2003

JAMES E. ROGAN
*Director of the United States Patent and Trademark Office*